US007303353B2

(12) United States Patent
Carey

(10) Patent No.: US 7,303,353 B2
(45) Date of Patent: Dec. 4, 2007

(54) RELOCATABLE TRANSPORTABLE SAFETY CRASH BARRIER SYSTEM

(75) Inventor: Anthony J. Carey, Springwood (AU)

(73) Assignee: Way-Togo Aussindo Pty Ltd, Springwood, Queensland (AU)

( * ) Notice: Subject to any disclaimer, the term of this patent is extended or adjusted under 35 U.S.C. 154(b) by 126 days.

(21) Appl. No.: 10/523,150

(22) PCT Filed: Jul. 24, 2003

(86) PCT No.: PCT/AU03/00942

§ 371 (c)(1),
(2), (4) Date: Sep. 2, 2005

(87) PCT Pub. No.: WO2004/009909

PCT Pub. Date: Jan. 29, 2004

(65) Prior Publication Data

US 2006/0115326 A1 Jun. 1, 2006

(30) Foreign Application Priority Data

Jul. 24, 2002 (AU) ..... 2002950330

(51) Int. Cl.

| | |
|---|---|
| ***E01F 13/00*** | (2006.01) |
| ***E01F 13/12*** | (2006.01) |
| ***E01F 15/00*** | (2006.01) |
| ***E01F 15/02*** | (2006.01) |
| *E01F 15/08* | (2006.01) |

(52) U.S. Cl. ..... 404/6; 404/9; 404/10

(58) Field of Classification Search ..... 404/6, 404/9, 10

See application file for complete search history.

(56) References Cited

U.S. PATENT DOCUMENTS

| | | | | |
|---|---|---|---|---|
| 3,643,924 | A * | 2/1972 | Fitch | 256/13.1 |
| 3,981,486 | A | 9/1976 | Baumann | |
| 4,869,617 | A * | 9/1989 | Chiodo | 404/6 |
| 5,286,137 | A * | 2/1994 | Cicinnati et al. | 404/6 |
| 5,452,963 | A * | 9/1995 | Christensen | 404/6 |
| 5,531,540 | A | 7/1996 | Wasserstrom et al. | |
| 5,876,020 | A * | 3/1999 | Giavotto | 256/13.1 |
| 5,882,140 | A * | 3/1999 | Yodock et al. | 404/6 |
| 5,988,934 | A * | 11/1999 | Wasserstrom | 404/6 |
| 6,059,491 | A * | 5/2000 | Striefel et al. | 405/111 |
| 6,086,285 | A * | 7/2000 | Christensen | 404/6 |
| 6,164,865 | A * | 12/2000 | McCallum | 404/6 |
| 6,413,009 | B1 * | 7/2002 | Duckett | 404/6 |

FOREIGN PATENT DOCUMENTS

| | | |
|---|---|---|
| DE | 8706088 | 10/1987 |
| EP | 0810325 | 12/1997 |
| FR | 2 745 310 | 8/1997 |
| WO | WO 01/11146 | 2/2001 |

* cited by examiner

*Primary Examiner*—Raymond W Addie
(74) *Attorney, Agent, or Firm*—Kirton & McConkie; Evan R. Witt

(57) ABSTRACT

A relocatable traffic barrier system including a plurality of elongate barrier modules (112, 113) connected end-to-end, each module having a cavity for receiving a ballast of a fluid material wherein the barrier system includes at least one crash rail (124) extending lengthwise along at least one side of the plurality of elongate barrier modules wherein the at least one crash rail is secured to selected elongate barrier modules by a deformable member (123), said deformable member being disposed between the at least one crash rail and the selected elongate barrier modules.

18 Claims, 8 Drawing Sheets

RELOCATABLE TRANSPORTABLE SAFETY CRASH BARRIER SYSTEM

FIELD OF THE INVENTION

The present invention relates to relocatable barriers, particularly of the type ballasted with fluid material such as water.

BACKGROUND

Elongate barrier systems are commonly used for such purposes as guiding traffic and preventing ingress of pedestrians and vehicles into particular areas such as building and excavation sites. One form of barrier system used in such circumstances consists of a number of matching generally elongate modules which are connected end-to-end to form a barrier, each module including or being a container adapted to be filled with a fluid such as water for ballast. The ballast provides the container with sufficient weight such that the barrier is not easily moved by contact from the type of traffic (pedestrians or slow moving vehicles) it is intended to control or guide.

Whilst such barriers are useful for these limited purposes they generally lack the ability to safely absorb impacts, such as accidental impacts by motor vehicles, without failure of the barrier or excessively large lateral displacement. Failure of the barrier upon impact by a vehicle moving at speed, generally in the direction of longitudinal axis of the barrier, can result in the vehicle breaching the barrier. This may result in the pedestrians or objects protected by the barrier being endangered by the vehicle similarly excessive displacement of the barrier may endanger pedestrians or objects behind the barrier.

Government agencies establish guidelines for crash barrier safety. For example, the United States Department of Transportation, Federal Highway Administration (FHWA) policy requires the use of devices on the National Highway System (NHS) that have been successfully tested in accordance with the guidelines contained in the National Cooperative Highway Research Program (NCHRP) Report 350, "Recommended Procedures for the Safety Performance Evaluation of Highway Features." State transportation agencies may establish different standards for non-NHS projects, but the United States FHWA recommends the use of crashworthy devices on all public facilities where run-off-the-road crashes may occur. Standards are provided for various highway safety features, including relocatable transportable work zone devices. Category 3 devices are subject to the full crash testing requirements of NCHRP Report 350, Levels 1 to 3. Level 3 is a 25 degree impact at 100 kmh with a 2000 kg pickup, and a 20 degree impact with a 820 kg sedan. Successful devices shall prevent penetration of the barrier line and control the deceleration of impacting vehicles by dissipating the vehicle's kinetic energy in a manner that does not cause violent decelerations which cause injuries to vehicle occupants. When struck, the barrier system shall redirect the errant vehicle back onto the roadway or bring the errant vehicle to a safe and controlled stop. Most of the available modular, ballasted longitudinal barrier style systems fail to meet these standards and where protection is required it is necessary to employ relocatable barriers of the type formed from concrete. The use of barriers formed from concrete increases the difficulty in transporting and positioning the barriers due to the extreme mass of the barrier elements that need to be transported and deployed.

Attempts have been made to modify ballasted barriers to enable them to function adequately as vehicular crash barriers. For example, one approach has been to provide an internal reinforced steel framework in each module, the framework being so designed that when modules are connected together by fasteners the frameworks are effectively connected together, thus increasing the crash-resistance of the barrier. This approach suffers from the disadvantage of complexity of manufacture, assembly and weight of the empty, or unballasted, modules We have now found a barrier that is able to resist impacts such as impacts by motor vehicles, and which avoids the use of modules with internal frameworks or bracing. The barrier system of the present invention allows the use of existing modular ballasted barriers, which is advantageous, but also encompasses the use of purpose built barrier modules. In either case, the problems associated with transport of barrier modules encumbered by the weight of internal framing are minimized or at least the consumer is provided with a useful or commercial choice. Also within the scope of the invention are fittings and fixtures for use in the construction of the barrier of the present invention.

SUMMARY OF THE INVENTION

According to one aspect of the invention, there is provided a relocatable traffic barrier system including a plurality of elongate barrier modules connected end-to-end, each module having a cavity for receiving a ballast of a fluid material wherein the barrier system includes at least one crash rail extending lengthwise along at least one side of the plurality of elongate barrier modules wherein the at least one crash rail is secured to selected elongate barrier modules by a deformable member said deformable member being disposed between the at least one crash rail and the selected elongate barrier modules.

In another aspect, the invention provides a method for installing a traffic barrier including connecting a plurality of elongate barrier modules end-to-end wherein each module comprises a cavity for receiving a ballast of a fluid material, ballasting at least some of the modules by filling respective cavities within said modules with a fluid material, securing a deformable member to selected modules and securing to the deformable members at least one crash rail extending lengthwise along at least one side of the barrier wherein the deformable member is disposed between the at least one crash rail and the selected elongate barrier modules.

In another aspect, the invention provides a deformable member for mounting a crash rail to at least one elongate barrier module, each of the at least one elongate barrier modules including a cavity for receiving a ballasting fluid, each said module being adapted for end-to-end connection to an adjacent elongate module, said deformable member including a first part for abutment with a first face of a said elongate barrier module and securable to said first face by at least one fastener, a deformable element extending from said first part, and a connection means for engagement of the crash rail to the deformable element.

DETAILED DESCRIPTION

The relocatable traffic barrier constructed in accordance with the present invention is greatly stiffened against lateral deflections due to vehicle impacts by the crash rail. The greater the number of modules to which a single span of the crash rail is secured, the better this stiffening effect will be. The crash rail or rails may be of known type, such as rolled steel "W" sections made for the purpose or proprietary designed steel sections. In addition to providing an alternative form of construction to existing traffic barriers with crash-resistance, the invention allows easy handling and transport, permitting modules to be brought to site with or without crash rails or the fittings attached and assembled into a continuous barrier by connecting them end-to-end. After attaching the fittings (if not attached to the modules before their connection together) the crash rail itself may be attached and the modules ballasted as necessary by filling with fluid.

The barrier may be formed from any convenient ballasted modular barriers. Each module has a cavity for receiving ballast in the form of a fluid material. The barriers are ballasted with a fluid material. The fluid material is preferably water but may be any other fluid material, including other liquids and friable solids, such as sand. The barrier of the present invention may be formed from existing transportable modular barriers, including those whose modules are water containers formed of plastics materials, or may be formed from purpose built modules.

It is particularly preferred that the modules are substantially formed of a plastics material.

The modules are connected end-to-end. The end-to-end connection may be by any convenient means known to those skilled in the art. In a preferred configuration the respective ends of the modules are capable of interlocking to enhance the end-to-end connection.

The barrier has at least one crash rail extending lengthwise along at least one side of the barrier. It is preferred that the crash rail be secured to at least one deformable member on each of the modules, or on each one of a contiguous plurality of the modules, included in the barrier. This minimizes "weak points" in the assembled barrier.

It is particularly preferred that the crash rail is formed of hot or cold-rolled steel. Preferably the crash rail is a steel W beam that is itself deformable hence it's structure. Other suitable crash rails include deformable QUAD beams.

A barrier according to the invention may have crash rails along both sides of the barrier, or where required, along one side only.

The at least one crash rail is secured to selected deformable members and said deformable member is secured to the barrier. The deformable member deforms on impact with the barrier by a vehicle or the like where the impact exceeds a predetermined force. Its preferred that the deformable member includes a deformable element design to absorb or accommodate the majority of the deformation of the member. The deformable member may preferably be a metal plate of selected thickness extending laterally from the barrier. The preferred form of the deformable element is a C-section of metal disposed vertically on a first portion of the deformable member with the open side of the C-section facing away from the oncoming traffic.

The at least one crash rail is secured to a deformable member. The deformable member may include a flange for affixing directly or indirectly to the at least one crash rail. In the fitting assembly of the present invention the flange may be considered the connection means.

The deformable member is secured to the barrier. Preferably the deformable member includes a flange for connection to the respective module. In the fitting assembly of the present invention this flange may be considered the first part.

In a preferred embodiment the deformable member is a c-shaped section of mild steel, preferably with the flanges directed away from the oncoming traffic.

The fitting assembly of the present invention has a first part co-operable with a first face of a said module and securable to said first face by at least one fastener, a deformable member extending from said first part, and a connection means for engagement with the crash rail It is preferred that the first part of the fittings conforms to a part of the contour of the module to which it is secured where it contacts the said module. At least one of the fittings may be adapted to be retained on a module by being captive on the module when assembled. For example, it may be captive in an opening or recess in the module. The said opening may be a hole defined by and passing through the module, such as those provided in some known plastic barriers to stiffen and (in filled condition) lighten them.

Preferably, the first part of the fittings is secured to a module by a fastener such as a nut/bolt assembly. In a particularly preferred arrangement, said fastener passes through each of a pair of adjacent modules thereby to connect the pair of modules. These or some of the said fittings may include a part generally in the form of a strap or plate extending over a part of the surface of the module and secured thereto by the fastener. These or some of the said fittings may be secured to the module by the said fastener indirectly via an intermediate fitting.

We have found that the modules typically have tapered, non vertical walls. The first portion of the deformable member is preferably in the shape of a bracket that has a vertical face spaced away from the module. This typically results in a wedge shaped aperture between the vertical face and the module. It is preferred that a plate or brace be positioned in this wedge shaped aperture to strengthen the first portion.

The fastener may be a bolt/nut assembly, with the nut or a head of the bolt lying when in use in a recess in the module, and the intermediate fitting including a washer part which lies in contact with said nut or head and at least one further part connected to the washer and extending out of the recess to the said fitting. The said fastener at least one further part of the intermediate fitting may pass through an opening formed in the fitting.

A fitting secured to a module by a fastener as disclosed above may extend over opposing sides of the module or modules and may be secured to the module on each of said sides by the fastener.

In order that the invention may be more fully understood and put into practice, preferred embodiments thereof will now be described with reference to the accompanying drawings.

BRIEF DESCRIPTION OF THE DRAWINGS

FIG. 1 shows a module 1 used for transportable barriers at building sites, for traffic guidance and the like. The phantom extension in the figure indicates the outlines of part of a barrier 2 assembled by connecting together, end-to-end, several matching barrier modules of this type, including modules 13 and 14. The module 1 is hollow and formed of a plastics material and is adapted to be filled with water or other liquid as ballast. There are holes 3 formed in the module 1 to stiffen the sides 4 of the module 1 against deflection due to hydrostatic pressure when the module 1 is filled. For end-to-end connection of the module 1 to other matching modules 13 and 14, protruding end pieces 5, 6, 7 and 8 are provided, which interlock with corresponding protrusions 15, 16, 17 and 18 on modules 13 and 14.

FIG. 2 is a cross-section at holes 9 and 10 (at a longitudinal station indicated by arrow "A") of the module 1 and shows how the protrusions 5 and 6 interlock with protrusions 15 and 16 of adjacent module 13. Connection of adjacent modules is by nut/bolt assemblies such as 19/19*a* and 20/20*a* passing through holes 9 and 10 of the protrusions 5 and 6 and matching holes 21 and 22 in module 13, and similarly at the other end of the module 1. The holes 9, 10, 21 and 22 are so formed that ballast liquid (not shown) is retained in the module 1.

FIG. 3 is an identical view to that in FIG. 2 of a module 24 of a barrier 23 according to the invention, the module 24 being of the same type as module 1. A fitting 25 is secured to the module 24 and to that fitting 25 is secured an elongate crash rail 26 of known type (i.e. of roll-formed steel, and having a "W" cross-section). Other types of crash rail could of course be used. A nut/bolt assembly 27 secures the crash rail 26 to the fitting 25.

Figure 4:
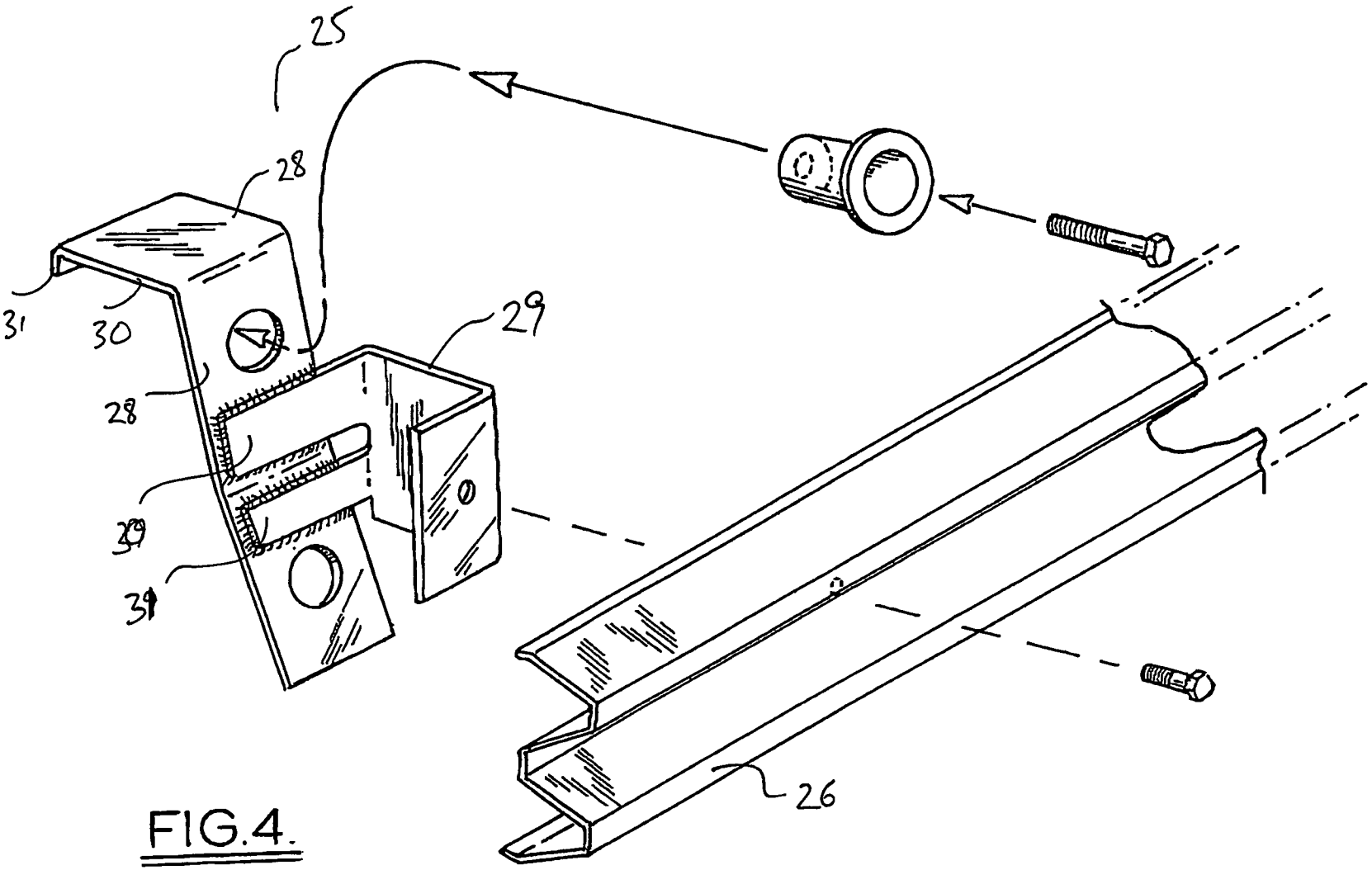
FIG. 4 is a perspective exploded view of certain parts of the barrier shown in FIG. 3.

As best seen in FIG. 4, the fitting 25 includes a steel strap 28, bent to conform to the cross-sectional shape of the assembled barrier 23. To the strap 28 is welded a support 29 for the crash rail 26. The strap 28 has sections 30 and 31 which allow the fitting 25 to sit stably on the module 24 for convenience during assembly of the barrier 23 before bolts 31 and 32 are passed through holes 33, 34, 35 and 36 in the module 24 and an adjacent module 37 to join modules 24 and 37. Assembly of nuts 38 and 39 with washers 40 and 41 to the bolts 31 and 32 completes the joining process.

Normally, but not essentially, the crash rail 26 is in sections of length exceeding the lengths of modules 24 and 37, such crash rail sections being bolted together as is known in the art.

Figure 1:
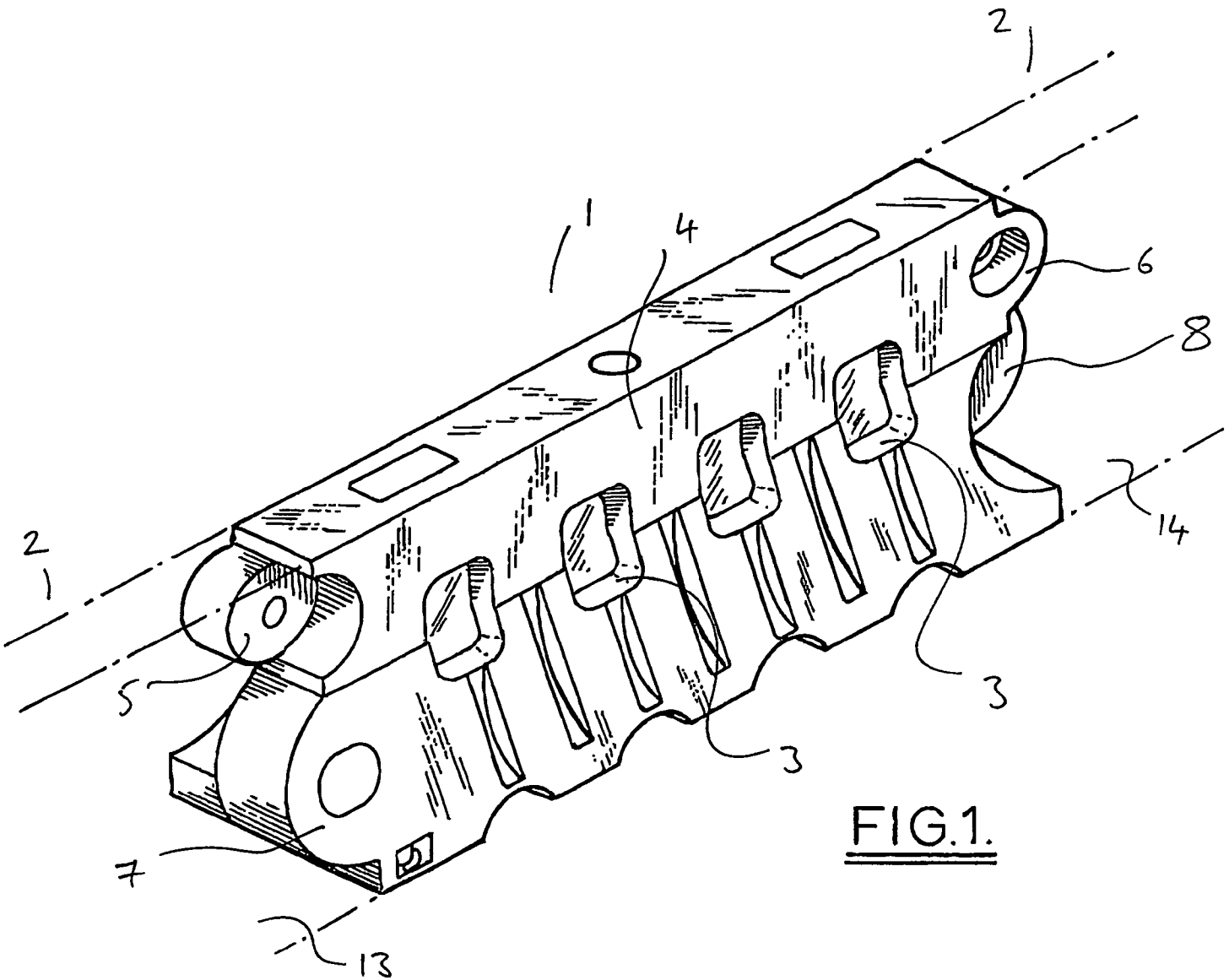
FIG. 1 is a perspective drawing of a known module such as is used for traffic barriers.
Figure 2:
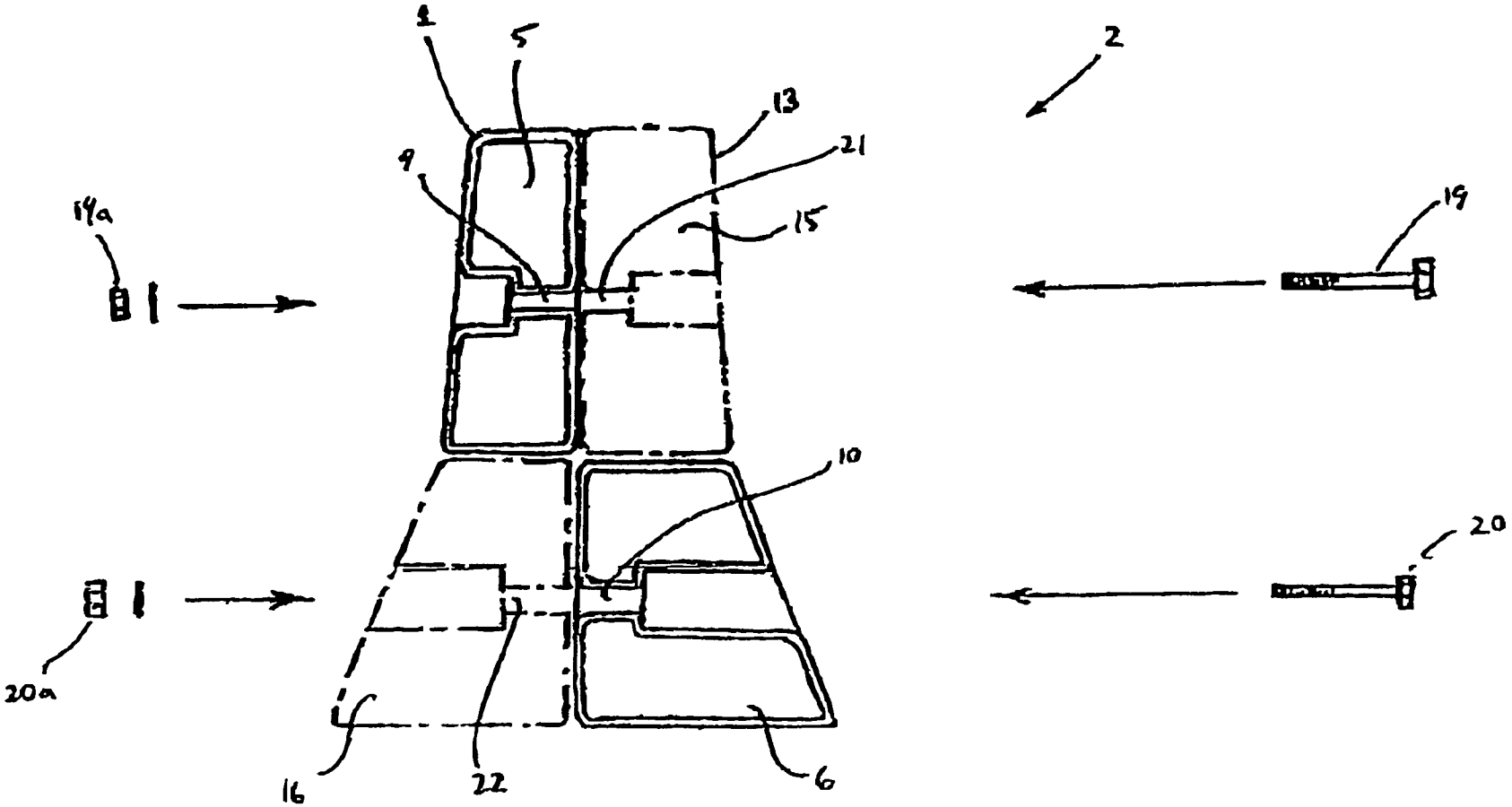
FIG. 2 is a cross-sectional view of the module shown in FIG. 1 taken at the station marked by arrow "A" in FIG. 1.
Figure 3:
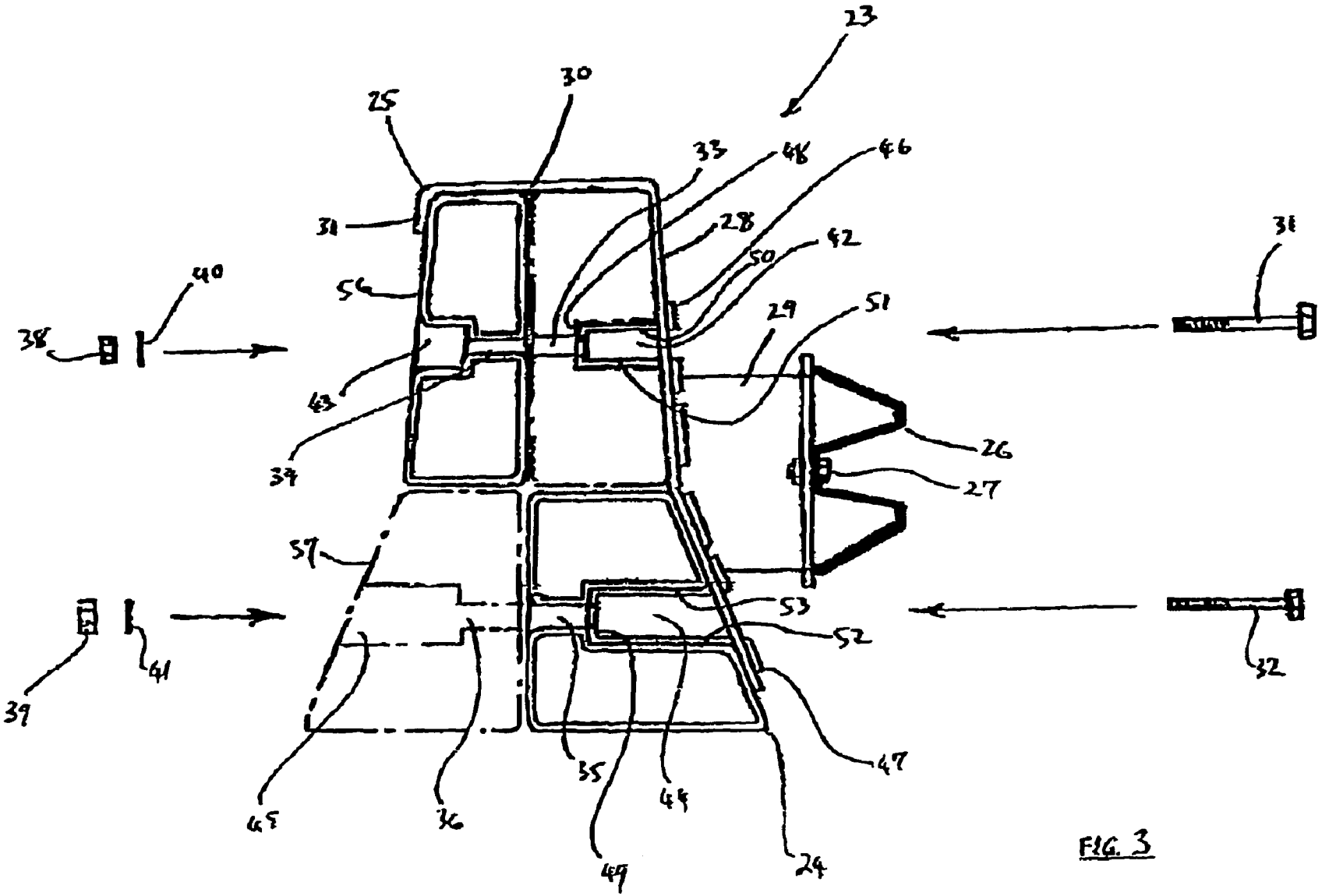
FIG. 3 is a cross-sectional view of the module shown in FIG. 1 taken at the same station as the view in FIG. 2, the module now being part of a barrier according to the invention.

It will be noted that the holes 33, 34, 35 and 36 lay within recesses 42, 43, 44 and 45. To enable the bolts 31 and 32 to retain the fitting 25 in place, intermediate fittings 46 and 47 are provided which have washer-like parts 48 and 49 through which bolts 31 and 32 pass. Extensions 50, 51, 52 and 53 pass through openings 54 and 55 in the strap 28 and in turn retain the strap 28 in place on the modules 24 and 37. Intermediate fitting 47 is omitted from FIG. 4 for clarity, but as can be seen in FIG. 3 is similar to intermediate fitting 46.

It will be immediately apparent that the strap 28 of the fitting 25 could be extended down the sides 56 and 57 of the modules 24 and 37 so that, via intermediate fittings (not shown) the same as intermediate fittings 46 and 47, the strap could be secured on both sides of the modules 24 and 37 by the bolts 31 and 32. This is also within the scope of the invention. It would also be possible to locate a support similar to the support 29 to such an extension of strap 28, so that a second crash rail (not shown) could be located on the opposite side of the barrier 23 to the crash rail 26. This also is within the scope of the invention.

Figure 5:
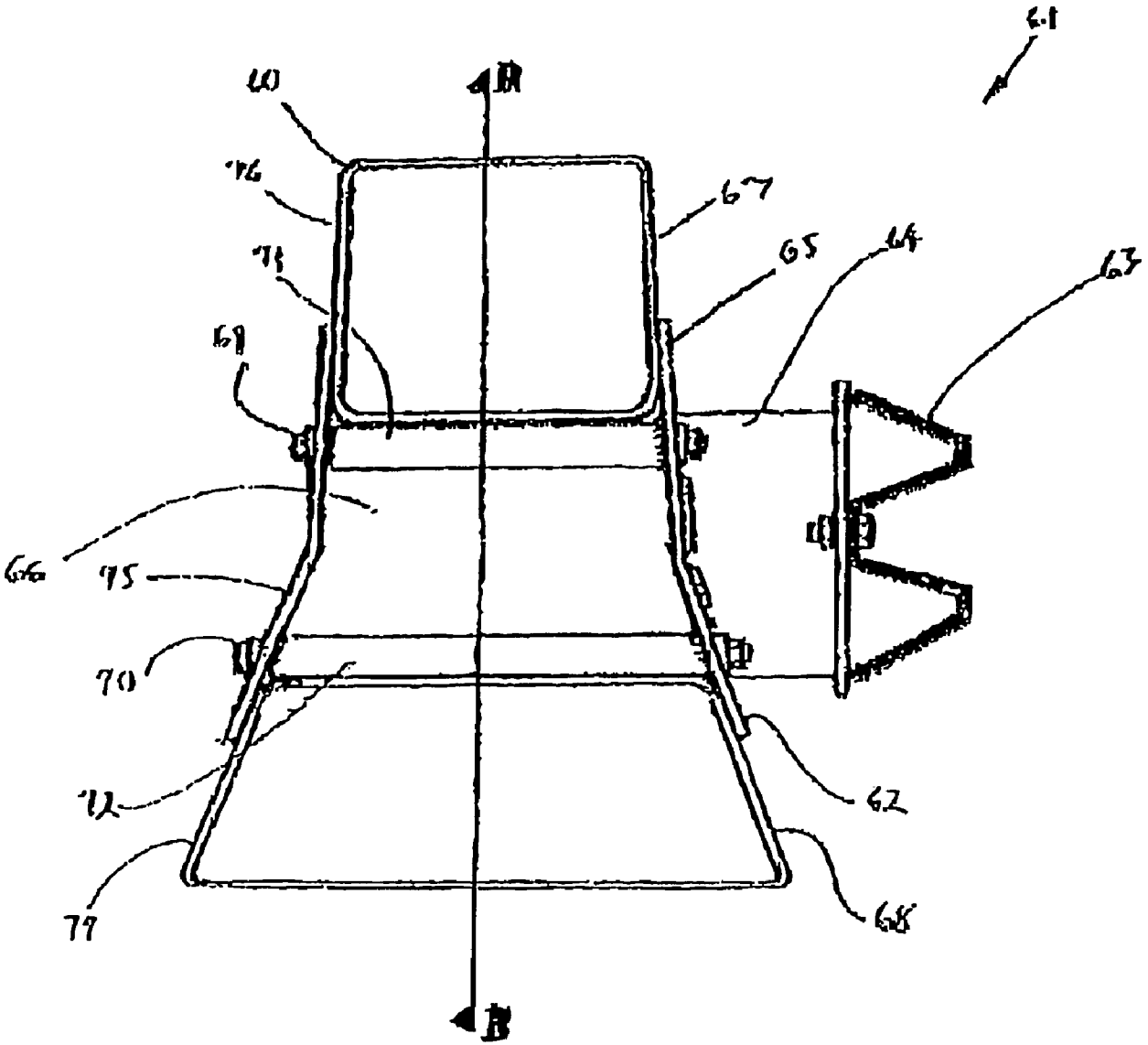
FIG. 5 is a cross-sectional view of a further embodiment of a barrier according to the invention taken at the longitudinal station marked by the dotted line "B" in FIG. 1.
Figure 6:
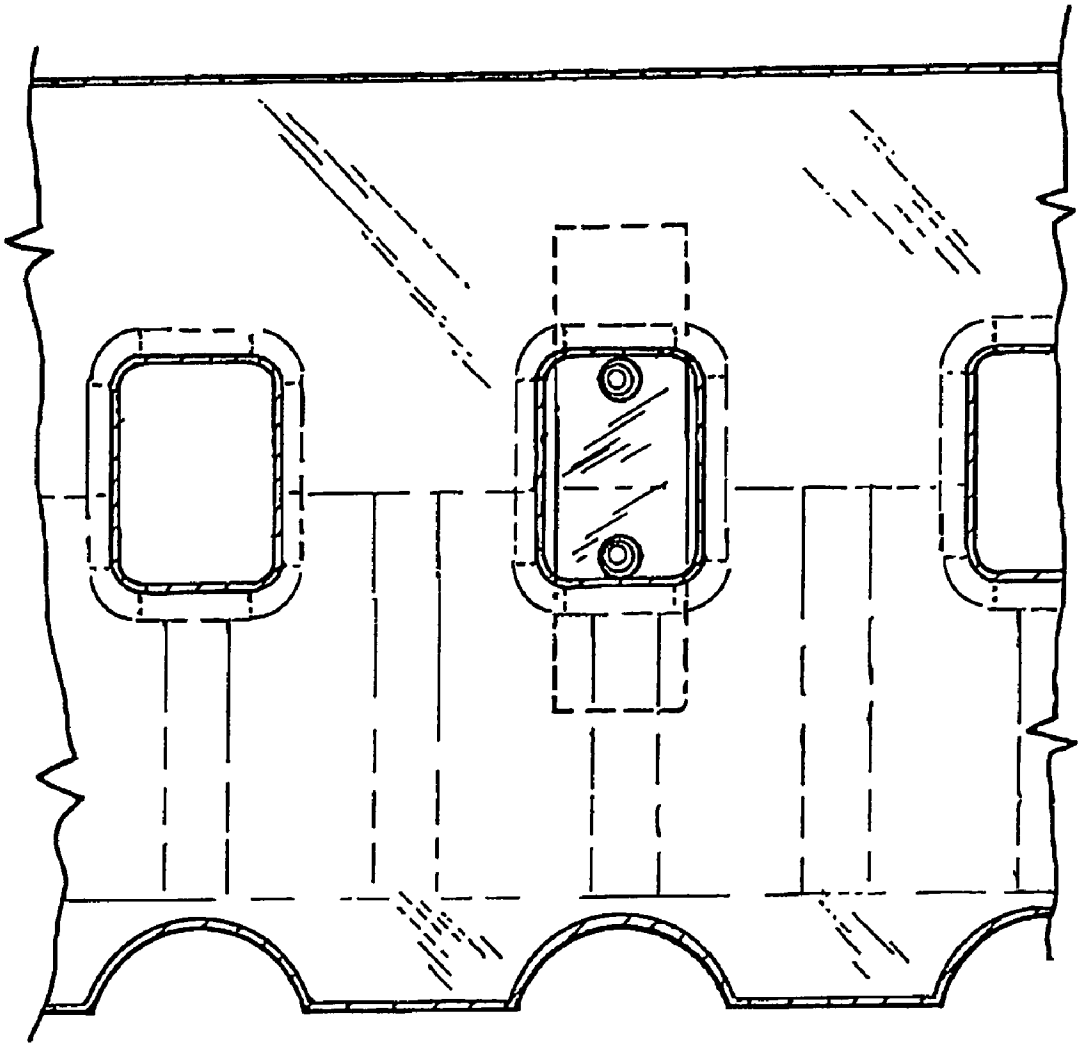
FIG. 6 is a partial cross-sectional view taken at "BB" in FIG. 5.

There are of course other ways to achieve the basic objective of providing one or more crash rails such as the crash rail 26 on a barrier made of modules such as the modules 1 or 24. FIG. 5 is a cross-sectional view of a module 60 of a barrier 61 according to the invention, the module 60 being of the same type as module 1. A fitting 62 including a support 64 is provided for mounting of a crash rail 63 and is captive in a lightening and stiffening hole 66 the same as the hole 3 of the module 1. A plate 65 conforming to the surfaces 67 and 68 of the module 60 is held thereagainst by bolt/nut assemblies 69, 70, 78 and 79. These pass through tubes 71, 72, 73 and 74 welded to the plate 65 and through a plate 75 bearing against the opposite sides 76 and 77 of the module 60. Thus the fitting 62 is captive in the hold 66, and the crash rail 63 is supported.

Still other ways of supporting an external crash rail on a barrier of modules such as module 1 will be apparent and lie within the scope of the invention. The descriptions above have been based on a particular style of module, but other module designs are known and a person skilled in the art could readily adapt the described parts to suit these. Moreover, purpose built modules could be made and used. These could for example have simpler and/or more convenient fixing arrangements for the fittings that support the crash rail or rails.

Figure 7:
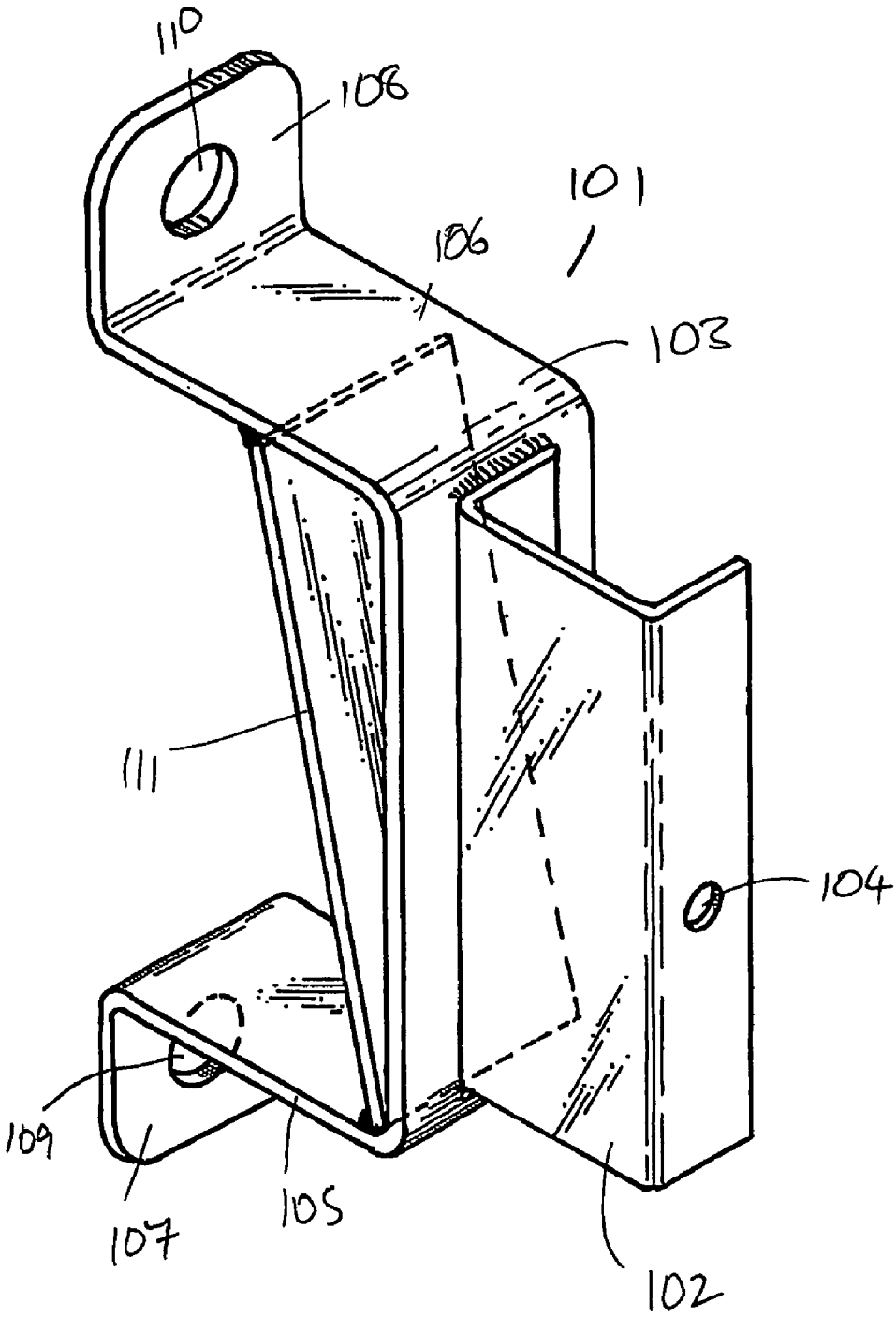
FIG. 7 is a perspective view of a deformable member according to a preferred embodiment of the present invention.

FIG. 7 shows a deformable member 101 having a vertically disposed deformable element 102 in the form of a metal C-section. The deformable element 102 is welded to a first portion 103. The C-section 102 has an aperture 104 through which a bolt (not shown) may be used to attach a crash rail (not shown).

The first portion 103 includes a pair of opposed leg members 105 and 106 respectively. Each of the leg members 105 and 106 have respective feet 107 and 108. Each of the feet 107 and 108 have apertures 109 and 110 for receiving bolts to affix the deformable member to the barrier module (not shown). The first member includes a brace 111 positioned to substantially follow the taper of the sidewalls of a barrier module (not shown). The brace 111 may be in the form of a stringer plate.

Figure 8:
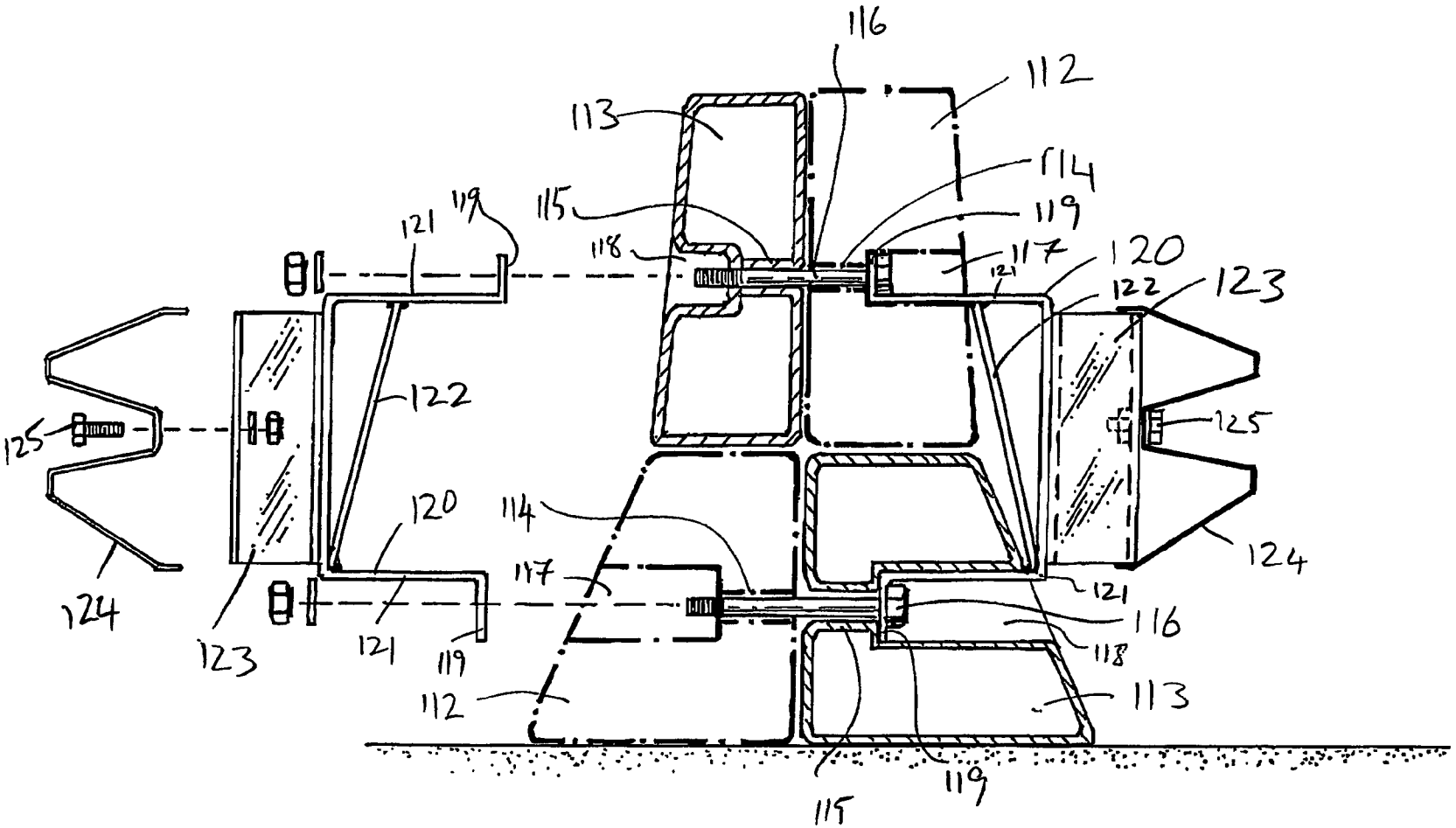
FIG. 8 is an exploded cross-sectional view of a relocatable barrier system according to a preferred embodiment of the present invention.

FIG. 8 shows in cross-section a pair of abutting barrier modules 112 and 113. The respective ends of the barrier modules 112 and 113 include elements that overlap and allow the abutting ends of the barrier modules 112 and 113 to be bolted together. The respective ends of the barrier modules 112 and 113 include apertures 114 and 115 through which a bolt 116 may be passed. The respective ends of the barrier modules 112 and 113 may include recesses 117 and 118 for receiving the feet 119 of the respective deformable members 120. The feet 119 may be retained within the respective recesses 117 and 118 and bolted to the respective ends of the barrier modules 112 and 113. The deformable members 120 include a pair of opposed legs 121 that extend from the respective recesses 117 and 118. A stringer plate 122 braces the legs 121. A C-section 123 extends from the first portion of the deformable member and a crash rail 124 is bolted to the C-section 123 with a bolt 125.

Persons skilled in the art will appreciate that the invention described above may be subject to improvements and modifications that will be apparent without departing from the spirit and scope of the invention described herein.

The invention claimed is:

1. A relocatable traffic barrier system including a plurality of elongate barrier modules connected end-to-end to form a contiguous plurality of the barrier modules, each barrier module having a cavity for receiving a ballast of a fluid material wherein the barrier system includes at least one crash rail extending lengthwise along at least one side of the plurality of elongate barrier modules wherein the at least one crash rail is secured to each of the elongate barrier modules by a deformable member, said deformable members being disposed between the at least one crash rail and the elongate barrier modules to space the at least one crash rail away from the barrier modules, wherein selected deformable members are secured to each of a pair of adjacent barrier modules where the adjacent barrier modules are connected end-to-end, such that the crash rail in combination with the elongate barrier modules safely absorbs vehicle impacts against the crash rail.

2. A relocatable traffic barrier system according to claim 1 wherein the fluid material is water.

3. A relocatable traffic barrier system according to claim 1 wherein the crash rail is formed from a plurality of sections and extends over and is mounted upon a plurality of adjacent barrier modules.

4. A relocatable traffic barrier system according to claim 1 wherein the crash rail is a steel W beam.

5. A relocatable traffic barrier system according to claim 1 wherein the deformable member includes a deformable element design to absorb or accommodate the majority of the deformation of the member.

6. A relocatable traffic barrier system according to claim 5 wherein the deformable element is a C-section of metal disposed vertically on a first portion of the deformable member with the open side of the C-section facing away from the oncoming traffic.

7. A relocatable traffic barrier system according to claim 1 wherein the deformable member includes a first portion and a deformable element wherein the first portion is in the shape of a bracket that has a vertical face spaced away from the module and wherein the first portion includes an angled brace.

8. A deformable member for mounting a crash rail to at least one elongate barrier module, each of the at least one elongate barrier modules including a cavity for receiving a ballasting fluid, each said elongate barrier module being adapted for end-to-end connection to an adjacent elongate barrier module, each said elongate barrier module comprising recesses extending into a first face of said elongate barrier module, said deformable member including a first part to be received within said recesses of a said elongate barrier module and securable to said recesses by at least one fastener, a deformable element extending from said first part, and a connection means for engagement of the crash rail to the deformable element, wherein the deformable member spaces the crash rail away from the barrier module, such that the crash rail in combination with the elongate barrier modules safely absorbs vehicle impacts against the crash rail.

9. A deformable member according to claim 8 wherein the deformable member includes a deformable element design to absorb or accommodate the majority of the deformation of the member.

10. A deformable member according to claim 9 wherein the deformable element is a C-section of metal disposed vertically on a first portion of the deformable member with the open side of the C-section facing away from the oncoming traffic.

11. A deformable member according to claim 8 wherein the deformable member includes a first portion and a deformable element wherein the first portion is in the shape of a bracket that has a vertical face spaced away from the module and wherein the first portion includes an angled brace.

12. A method for installing a traffic barrier including:

connecting a plurality of elongate barrier modules end-to-end to form a contiguous plurality of the barrier modules, wherein each barrier module comprises a cavity for receiving a ballast of a fluid material, ballasting at least some of the modules by filling respective cavities within said modules with a fluid material, securing a deformable member to each of the barrier modules, and securing to the deformable members at least one crash rail extending lengthwise along at least one side of the barrier modules, wherein the deformable members are disposed between the at least one crash rail and the barrier modules to space the at least one crash rail away from the barrier modules, wherein the deformable members are connected to and disposed between each of a pair of adjacent barrier modules, such that the crash rail in combination with the elongate barrier modules safely absorbs vehicle impacts against the crash rail.

13. A method for installing a traffic barrier according to claim 12 wherein the crash rail is formed from a plurality of sections and extends over and is mounted upon a plurality of adjacent barrier modules.

14. A method for installing a traffic barrier according to claim 12 wherein the crash rail is a steel W beam.

15. A method for installing a traffic barrier according to claim 12 wherein the deformable member includes a deformable element design to absorb or accommodate the majority of the deformation of the member.

16. A method for installing a traffic barrier according to claim 12 wherein the deformable member includes a first portion and a deformable element wherein the first portion is in the shape of a bracket that has a vertical face spaced away from the module and wherein the first portion includes an angled brace.

17. A relocatable traffic barrier system according to claim 1 wherein selected deformable members are secured to the elongate barrier modules by fasteners, wherein selected fasteners pass through each of a pair of adjacent barrier modules thereby to connect the pair of modules to each other and to secure the deformable members to the elongate barrier modules.

18. A deformable member according to claim 8 wherein selected fasteners pass through each of a pair of adjacent barrier modules thereby to connect the pair of barrier modules to each other and to secure the deformable members to the elongate barrier modules.

* * * * *